United States Patent [19]

Dvirka et al.

[11] 3,995,568

[45] Dec. 7, 1976

[54] INCINERATOR AND COMBUSTION AIR SYSTEM THEREFOR

[76] Inventors: Miro Dvirka, 78 Pond Road, Woodbury, N.Y. 11797; Keith Stewart, 205 Henry St., Massapequa Park, N.Y. 11762

[22] Filed: Nov. 12, 1975

[21] Appl. No.: 631,400

[52] U.S. Cl. ..... 110/8 R; 110/72 B; 110/101 C

[51] Int. Cl.[2] ..... F23G 5/00; F23L 1/02; F23L 9/02; F23K 5/00

[58] Field of Search ..... 110/8 R, 8 C, 18 R, 110/72 B, 101 R, 101 C

[56] References Cited

UNITED STATES PATENTS

| | | | |
|---|---|---|---|
| 2,978,997 | 4/1961 | Pierce | 110/101 X |
| 3,298,338 | 1/1967 | Clark, Sr. | 110/101 |
| 3,552,335 | 1/1971 | Dvirka | 110/8 |
| 3,818,846 | 6/1974 | Reese | 110/8 |
| 3,855,950 | 12/1974 | Hughes et al. | 110/8 |

*Primary Examiner*—Kenneth W. Sprague
*Attorney, Agent, or Firm*—Mason, Fenwick & Lawrence

[57] ABSTRACT

A refuse disposal system is disclosed including a combustion chamber, means disposed in the combustion chamber for supporting refuse to be burned, means for charging refuse on the support means, overfire means for supplying an increasing flow of combustion air above the support means as the temperature of the gaseous products of combustion increases above a first predetermined temperature, underfire means for supplying a decreasing flow of combustion air under the support means as the temperature of the gaseous products of combustion increases above the first predetermined temperature, override means for overriding the underfire means to decrease the flow of air under the support means when the temperature of the products of combustion decreases below a second lower predetermined temperature and means for reducing the rate with which the charging means places refuse on the support means when the temperature of the gaseous products of combustion increases above the first predetermined temperature.

15 Claims, 2 Drawing Figures

INCINERATOR AND COMBUSTION AIR SYSTEM THEREFOR

This invention relates to refuse disposal systems for burning heterogeneous materials and more particularly to a refuse disposal system with improved controls for the supply of air and for the flow of refuse into the disposal system.

The presently known overfire air and underfire air refuse disposal system as shown in U.S. Pat. No. 3,552,335 maintains the combustion temperature at a predetermined temperature by simultaneously varying the proportion of the underfire and overfire air. The variation in underfire air controls the burning rate of the refuse on the burning grate and the variation in overfire air provides the proper amount of air to complete the combustion of gases over the grate and to cool the gaseous products of combustion to an acceptable level thereby preventing the overheating of the combustion chamber enclosure. Combustion air is supplied at close to the stoichiometric air requirement for the refuse being burned to maintain the temperature of the gaseous products of combustion at a predetermined temperature. Since the actual flame temperature will usually be too high for the combustion chamber refractory enclosures, the flame and products of combustion are cooled by excess air supplied over the grate as "overfire air". With refuse having a high heat value the stoichiometric supply of air will increase the flame temperature beyond on acceptable limit and cause damge to the combustion chamber refractory enclosure. Therefore, the air flow under the grate is automatically reduced to decrease the actual burning rate. The decreased burning rate is caused by the oxygen deficient atmosphere supplied to the refuse which causes the formation of carbon monoxide in place of carbon dioxide because the partial combustion of the refuse reduces the liberation of the heat of combustion thereby decreasing the flame temperature. When refuse of very low heat value, such as wet refuse, is introduced into the furnace, the flame temperature will begin to drop. The presently known system will compensate for the low heat content of the refuse by reducing the overfire airflow and increasing the underfire inflow to attempt to increase the burning rate of the refuse. A high moisture content in any refuse acts as a retardant in the combustion process while the burning rate of the refuse can be increased to a certain limit by the use of underfire air. Beyond that limit the increased supply of air will reduce the flame temperature rather than increase it. Consequently, the incinerator temperature will continue to decrease, and may be reduced to the point of extinguishing the flame. With present systems the prevention of such occurrences is accomplished by manually reducing the underfire air flow which requires constant supervision by the incinerator operator.

Accordingly, it is the principal object of the present invention to provide a novel refuse disposal system.

Another object of the present invention is to provide a fully automatic refuse disposal system which is capable of burning a wide range of combustible refuse without attendance by an operator.

A further object of the present invention is to provide a refuse disposal system which automatically prevents extinguishment of the fire due to excessive underfire air.

A still further object of the present invention is to provide a novel refuse disposal system which provides improved efficiency and produces a uniform quality residue from a heterogenous refuse.

Another object of the present invention is to provide a novel control system for a refuse disposal system which improves operation of the disposal system during cold startup to reduce pollution to the atmosphere by quickly achieving a uniform temperature within the combustion chamber.

Another object of the present invention is to provide a novel control system for refuse disposal systems which eliminates the need for visual observation of burnout quality of the residue thereby reducing the labor costs necessary to operate such a system.

A still further object of the present invention is to provide a novel control system for refuse disposal systems of the type having under fire and over fire air supplies with the control system automatically preventing extinguishment of the flame.

Other objects and advantages of the present invention will become apparent to those persons having ordinary skill in the art to which the invention pertains, from the following description taken in conjunction with the accompanying drawings, wherein.

Figure 1:
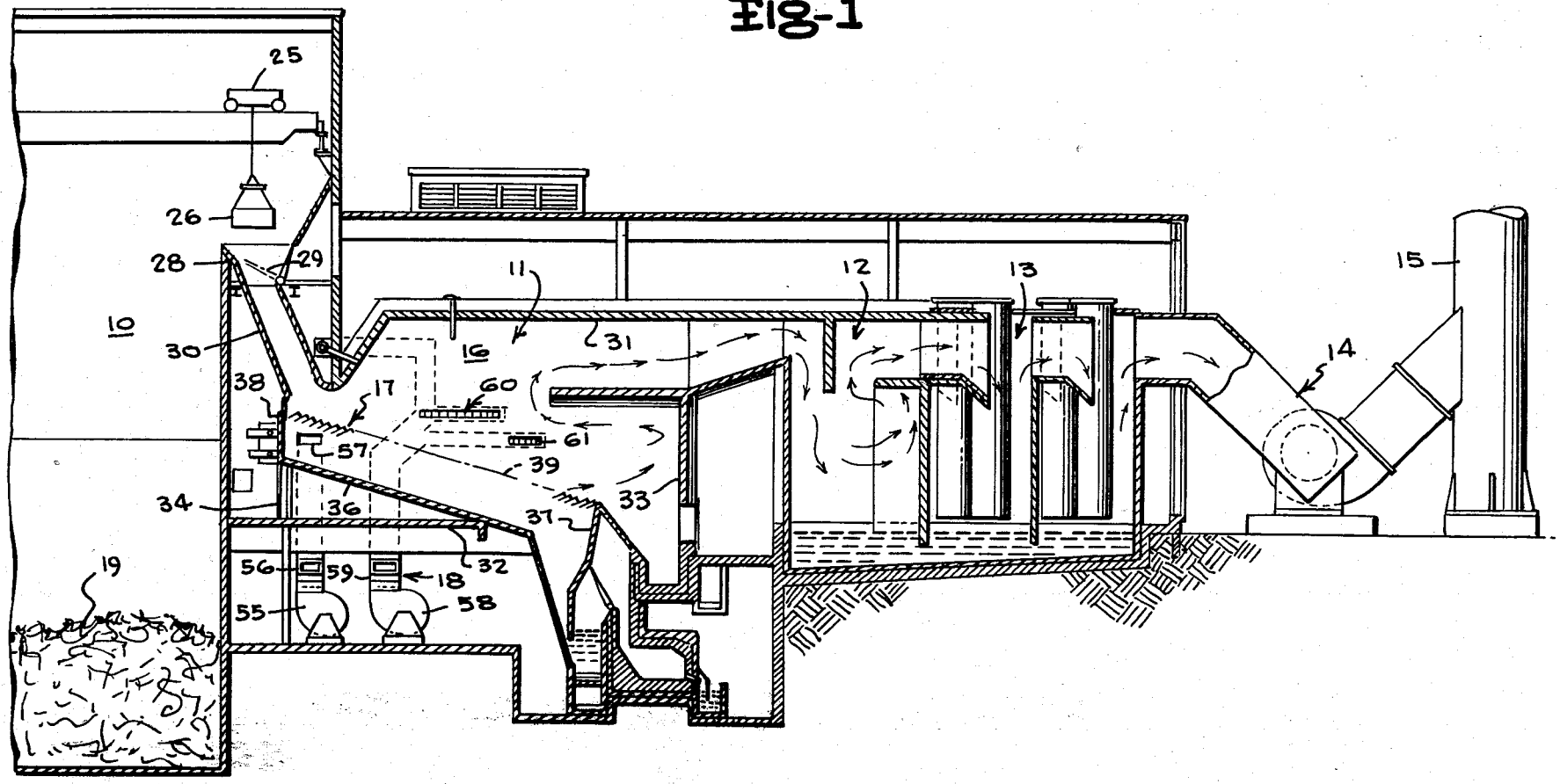
FIG. 1 is a fragmentary vertical cross-sectional view of a refuse disposal system which may utilize the present invention.

Referring first to FIG. 1, there is illustrated a refuse disposal system on which the present invention may be utilized. The refuse disposal system includes a refuse storage enclosure 10, an incinerator 11, a settling chamber 12, a gas scrubber unit 13, a controlled induced draft system 14 and an exhaust stack 15. The incinerator 11 includes a chamber 16, a stoker 17 disposed in the combustion chamber, and a controlled air supply system 18.

Refuse 19 from the refuse storage enclosure is transported and charged into the incinerator 11 by means of an overhead crane 25. The refuse is charged into a hopper 28 having a closing gate 29 and a charging chute 30 for conveying refuse to the upper end of the stoker 17.

The combustion chamber 16 of the incinerator is defined by an upper wall 31, a bottom wall 32, a front wall 33, a rear wall 34, and sidewalls. The stoker 17 is positioned in the combustion chamber to receive refuse through the charging chute 30, and generally includes an inclined bottom wall 36, a front wall 37, a rear wall 38, and a plurality of stationary and movable grates 39. The plurality of grates 39 is disposed at an angle to the horizontal, and is spaced from the bottom wall 36 of the stoker. A conventional hydraulic drive mechanism is provided to reciprocate the movable grates of the stoker. Preferably, the grates are reciprocated to provide a stoking action whereby the refuse is caused to tumble along the length of the stoker. Such stoking action functions to expose a maximum area of the refuse for burning. The combustion chamber 16 will be operated at a temperature in the range of 1,600° to 1,800° F.

Figure 2:
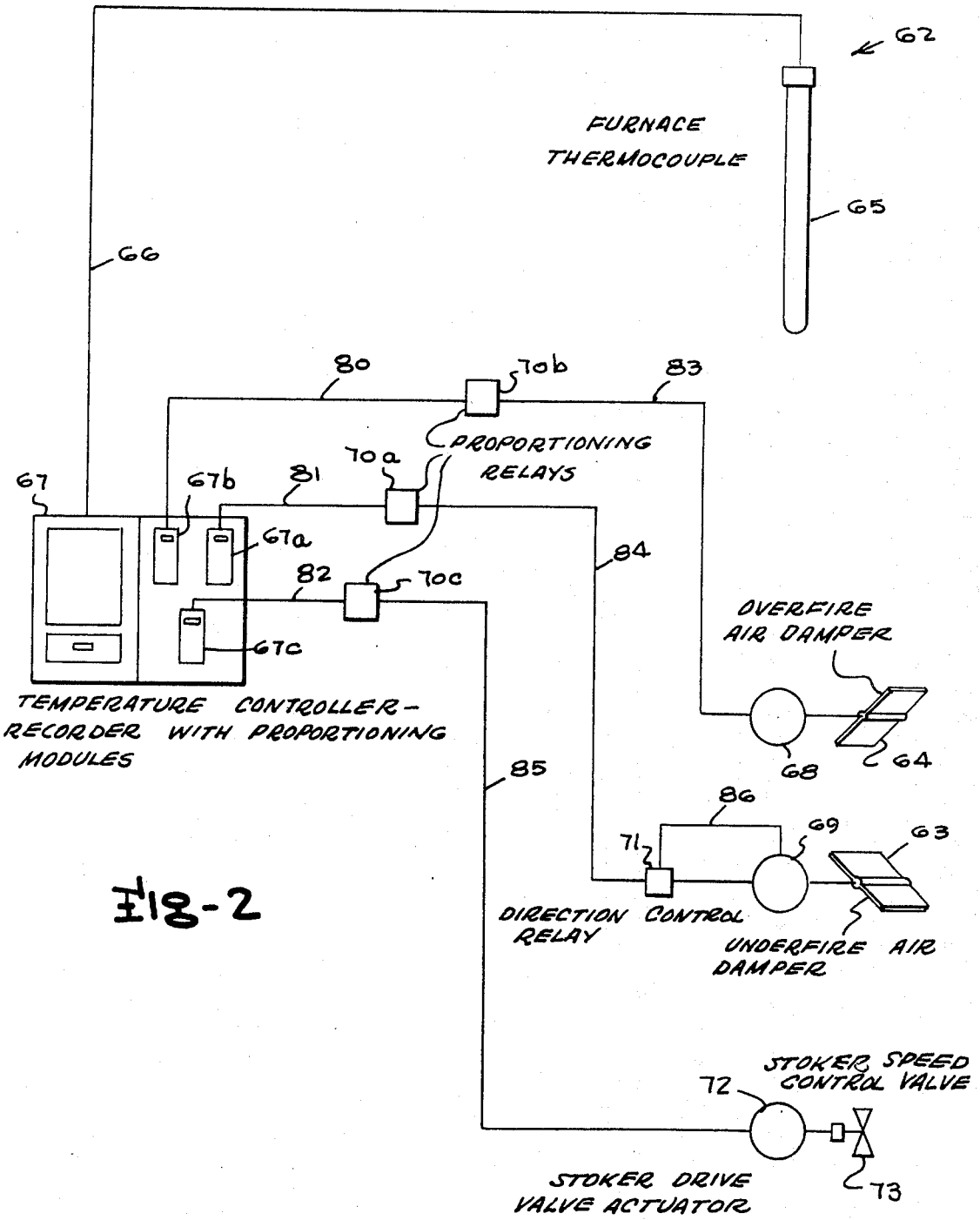
FIG. 2 is a schematic diagrammatic view of the control system of the present invention.

The system 18 for supplying a controlled amount of air to the combustion chamber 16 consists of a blower 55 having a duct system 56 for supplying underfire air through outlet openings 57 in the sidewalls to the underside of the plurality of grates 39, a separate blower 58 having a duct system 59 for supplying overfire air through banks of nozzles 60 and 61 in the sidewalls of the combustion chamber to the upper side of the plurality of grates 39 of the stoker, and a control system 62 as illustrated in FIG. 2. The banks of nozzles 60 and 61 are mounted in the sidewalls of the combustion chamber immediately above the bed of refuse on the stoker 17, and are disposed substantially along the length of the stoker. The supply of underfire or overfire air is controlled by a pair of dampers 63 and 64 in the duct systems 56 and 59 which are operated by the control system 62.

The control system 62 includes a thermocouple 65 connected by a lead wire 66 to a temperature controller recorder 67 with proportioning modules where the proportioning modules include the underfire module 67*a*, the overfire module 67*b* and the stoker module 67*c*. The modules may be Honeywell W949A Automatic-Manual Transfer Stations with Honeywell Diala Trol R7352 position-proportioning controllers. Overfire and underfire damper control motors 68 and 69 are position proportioning electrical control motors which are operatively connected to the dampers 63 and 64.

The underfire air module 67*a* actuates the underfire proportioning motor 69 through an underfire proportioning relay 70*a* such as a Honeywell Proportioning Relay R7165A and through a direction control relay 71 to position the overfire damper 63 at the desired position as determined by the signal from the thermocouple 65. The direction control relay 71 is in turn operatively connected to an adjustable switch in the temperature controller 67 which deenergizes the direction relay when the temperture in the combustion chamber 16 drops to a predetermined temperature. The purpose of the direction control relay is to drive the damper motor 69 to a lower proportioning band and to produce a minimum air flow condition with the underfire damper 63.

The overfire air module 67*b* actuates the overfire proportioning relay 70*b* such as a Honeywell Proportioning Relay R7165A to position the underfire damper 63 at the desired position as determined by the signal from the thermocouple 65.

The stoker 67*c* actuates a proportioning valve motor 72 through a proportioning relay 70*c* similar to 70*a* and *b* to control the rate of flow of hydraulic fluid through a stoker speed control valve 73 which in turn controls the feed rate of the hydraulic drive on the stoker 17.

The proportioning modules 67*a*, 67*b* and 67*c*, damper control motors 68 and 69, the valve motor 72, the proportioning relays 70*a*, 70*b* and 70*c* and the direction control relay 71 are operatively connected by wire connections 80, 81, 82, 83, 84, 85 and 86 as illustrated.

The control system 62 functions to maintain the temperature of the combustion chamber within a predetermined temperature range to create optimum operating conditions for the complete and efficient burning of the refuse deposited by the stoker on the grate in the combustion chamber while preventing the flame and combustion chamber temperature from being reduced to the point of ignition-extinction at which all combustion of the refuse would be extinguished. Additionally, the control system increases the flow rate of the refuse along the stoker when the temperature of the combustion chamber exceeds a predetermined temperature range to increase the efficiency and load capacity of the system.

It is preferred that the system be operated in the range of 1600° to 1800° F. The temperature in the combustion chamber can be controlled and maintained between the preferred limits by controlling the amount of overfire and underfire air supplied to the combustion chamber. The combustion chamber temperature may be reduced by increasing the amount of overfire air with or without smultaneous decreasing the underfire air. Similarly, the combustion chamber temperature may be raised by increasing the underfire air with or without increasing the overfire air.

The amount of overfire and underfire air supplied to the combustion chamber can be controlled by adjusting the positions of the damper 63 and 64. This can be accomplished by use of the control system 62.

The combustion chamber temperature may additionally be reduced by increasing the speed with which the stoker feeds refuse onto the burning grate 39. When refuse of very low heat value, usually wet material, is introduced into the combustion chamber, the combustion chamber temperature will start to drop. To compensate for the low heat content of the fuel, the system will decrease the amount of overfire air and increase the amount of underfire air, thereby attempting to increase the burn rate of the refuse. The high moisture content of the refuse acts as a retardant to the combustion process which prevents the burn rate of the refuse from being increased by the use of underfire air above a certain rate of air flow. Beyond this amount of underfire air, the increased flow will act as excess air and will further reduce the flame temperature rather than increasing it. Consequently, the flame and combustion temperatures will continue to drop and can be reduced to the point of extinguishing the combustion flames.

When the combustion chamber temperature drops below the normal selected combustion chamber temperature to a second predetermined temperature, the direction relay 71 automatically reverses the travel of the underfire air damper 63 while maintaining a proportional operating mode, which causes the underfire air damper to close with decreasing combustion chamber temperatures while the overfire air damper stays closed. The closing of the underfire air damper when the furnace is below the second predetermined temperature prevents the excess underfire air from extinguishing the flame in the refuse. This feature is particularly advantageous when the refuse is wet or when the system is being operating from a cold start up. Once the combustion chamber temperature increases above the second predetermined temperature, the system returns to its normal operation.

In the operation of the control system 62 to maintain the temperature of the combustion chamber between the upper and lower temperatures such as 1800° and 1600° F, the temperature controller 67 with underfire air module 67*a* and the overfire air module 67*b*, are adjusted to transmit command signals to the damper control motors 68 and 69 to position the dampers 64 and 63 responsive to an input signal from the thermocouple 65. The stoker proportioning module 67*c* is adjusted to transmit a command output signal to the proportioning valve motor 72 responsive to the input signal from the thermocouple 65. The electrical connections from the motors 68 and 69 are adjusted to that the position of the dampers 63 and 64 will be in opposite directions so as to increase the air supply in the duct system 56 while decreasing the air supply in the duct system 59, and vice versa.

The degree of positioning of the dampers 63 and 64 may be proportioned by a proper adjustment of the proportioning relays 70*a* and 70*b*. The direction control relay 71 reverses the direction of movement of the underfire air damper motor 69 when the input signal from the thermocouple 65 indicates a second predetermined set point (for example, 900° to 1000° F) which is below the desired set point for operating the combustion chamber (for example, 1700° F). This reversal causes the underfire damper to closes with decreasing temperatures below the second predetermined set point.

The stoker module 67*c* is adjusted to transmit a command output signal to the proportioning valve motor 72 to position the stoker speed control valve 73 responsive to the input signal from the thermocouple 65. The electrical connection of the proportioning valve motor 72 are adjusted so that the stoker speed will be increased as the temperature in the combustion chamber increases. With such connections, whenever the thermocouple 65 senses a temperature in the combustion chamber, it will transmit a signal to the controller unit 67.

When the refuse disposal system is placed in operation from the cold startup condition, the overfire air damper 64 and the underfire damper 63 will be closed while still permitting a low rate of air flow to pass into the combustion chamber to prevent suffocation of the combustion process. This low air flow permits the refuse to burn and increase the temperature in the combustion chamber. As the temperature increases, the underfire air damper 63 will open wider to permit an additional air flow to be provided under the stoker to promote combustion of the refuse on the stoker.

When the temperature of the combustion chamber, sensed by the thermocouple 65, increases to the lower set point, the direction control relay 71 will be activated to automatically reverse the direction of travel of the underfire air damper while maintaining the proportional operating mode. The overfire air damper 64 remains closed. This movement causes the temperature of the combustion chamber to increase by supplying the refuse with additional underfire air which increases the rate of burning of the refuse and by preventing the flow of overfire air which would cool the gaseous products of combustion.

When the temperature in the combustion chamber reaches the normal operating set point, the proportional modules 67*a* and 67*b* transmit output signals to the position control motors 68 and 69 to open the damper 64 and proportionally close the damper 63. The effect of such damper adjustment will be to supply a greater amount of overfire air, thus cooling the flame and the products of combustion, and simultaneously decreases the underfire air to retard combustion Similarly, whenever the thermocouple senses the temperature in the combustion chamber falling below the normal set point (1700° F) an appropriate signal will be transmitted to the control units which correspondingly transmit a command output signal to the position control motors 68 and 69, to close the damper 64 and open the damper 63. The effect of such adjustment of the damper positions will be to decrease the supply of overfire air, tending to cool the flame and increase the supply of underfire air to promote combustion of the refuse on the stoker.

If refuse of low heat value begins to flow into the combustion chamber, the temperature of the combustion chamber may decrease below the normal set point with the overfire air damper 64 closing and the underfire air damper 63 opening as the temperature decreases to the lower set point at which the signal from the thermocouple 65 causes the direction relay 71 to reverse the movement of the underfire air damper, thereby causing the underfire air damper to close with additional decreases in temperature to prevent extinguishment of the flames in the combustion chamber.

The operation of the stoker drive is similar to the overfire air system and increases the capacity of the system to burn refuse by increasing the flow rate of refuse into the system when refuse of higher heat value is being burned and decreasing the flow rate of refuse when refuse of lower heat value is being burned. The control of stoker speed yields a uniform quality of residue which is preferably a complete burnout of the refuse.

With decreasing combustion chamber temperatures caused by wet refuse, the stoker will slow down allowing for greater retention time of refuse within the system. Conversely, with increasing combustion chamber temperature which is usually caused by refuse being dryer, the stoker speed will increase and process this more combustible refuse at a higher rate. The speed at which the stoker operates is controlled by the stoker speed control valve 73 which is positioned by the proportionally valve motor 72 and may be proportioned by a proper adjustment of the proportioning relay 70*c*. Whenever the thermocouple 65 senses the temperature in the combustion chamber rising above the normal set point (1700° F), it will transmit a signal to the stoker proportioning module 67*c* which will transmit an output signal to the positioning valve motor 72 to proportionally open the stoker speed control valve 73, thereby increasing the feed rate of the stoker.

The combination of a direction control relay 71 for the position control motor 69 which causes the direction of the underfire air damper to reverse when a set point below the normal operating temperature of the refuse disposal system is reached and a stoker speed control system provides a responsive system for preventing the extinguishement of the combustion when the temperature in the combustion chamber decreases below a lower set point and for maximizing the burn rate of refuse within the system.

From the foregoing detailed description, it will be evident that there are a number of changes, adaptations and modifications of the present invention which come within the province of those skilled in the art. For example, the stoker may be operated by a variable speed electrical motor stoker drive unit with the speed of the stoker drive being proportional to the temperature in the combustion chamber when the combustion chamber temperature is operated above a normal set temperature. It is intended, however, that all such variations not departing from the spirit of the invention be considered as within the scope thereof and limited solely by the appended claims.

I claim:

1. A refuse disposal system capable of incinerating heterogeneous refuse said system comprising a combustion chamber, means disposed in the combustion chamber for supporting refuse to be burned, means for charging refuse onto the support means, overfire means for supplying an increasing flow of combustion air above the support means as the temperature of the gaseous products of combustion increases above a first predetermined temperature, underfire means for supplying a decreasing flow of combustion air below the support means as the temperature of the gaseous products of combustion increases above the first predetermined temperature, and override means for overriding the underfire means to decrease the flow of air under the support means when the temperature of the gaseous products of combustion decreases below a second predetermined temperature.

2. The refuse disposal system of claim 1 wherein the override means decreases the flow of air under the support means to a predetermined minimum flow rate before the temperature of the combustion chamber has decreased to the temperature of the surrounding environment.

3. The refuse disposal system of claim 1 wherein the second predetermined temperature is lower than the first predetermined temperature.

4. The refuse disposal system of claim 3 wherein the second predetermined temperature substantially lies within the temperature range of 900° to 1,100° F.

5. The refuse disposal system of claim 1 wherein the underfire means includes a position proportioning electrical control motor operatively connected to an underfire air supply and a position proportioning control unit operable responsive to a signal generated by a thermocouple disposed in said combustion chamber to transmit an output signal to said proportioning electrical control motor and said override means includes a means for reversing the direction of rotation of the said control motor as the signal generated by the thermocouple indicates a decreasing temperature in the combustion chamber below the second predetermined temperature.

6. The refuse disposal system of claim 5 wherein said reversing means includes a direction control relay operatively connected to the position proportioning electrical control motor and operatively responsive to a signal generated by a thermocouple disposed in said combustion chamber to transmit an output signal to the direction control relay to reverse the direction of rotation of the control motor when the signal generated by the thermocouple indicates a decreasing of temperature below a second predetermined temperature.

7. A refuse disposal system capable of incinerating heterogeneous refuse, said system comprising a combustion chamber, means disposed in the combustion chamber for supporting refuse to be burned, means for charging refuse onto the support means, overfire means for supplying an increasing flow of combustion air above the support means as the temperature of the gaseous products of combustion increases above a first predetermined temperature, underfire means for supplying a decreasing flow of combustion air below the support means as the temperature of the gaseous products of combustion increases above the first predetermined temperature, override means for overriding the underfire means to decrease the flow of air under the support means when the temperature of the gaseous products of combustion decreases below a second predetermined temperature, and speed means for increasing the rate with which the charging means places refuse on the support means as the temperature of the gaseous products of combustion increases above the first predetermined temperature.

8. The refuse disposal system of claim 7 wherein the charging means is hydraulically driven and the speed means includes a position proportioning electrical control motor operatively connected to a speed control valve means for metering the flow of hydraulic fluid to the hydraulic drive of the charging means and includes a position proportioning control unit operatively responsive to a signal generated by a thermocouple disposed in said combustion chamber to transmit an output signal to said proportioning electrical control motor.

9. The refuse disposal system of claim 7 wherein the underfire means includes a position proportioning electrical control motor operatively connected to an underfire air supply and a position proportioning control unit operable responsive to a signal generated by a thermocouple disposed in said combustion chamber to transmit an output signal to said proportioning electrical control motor and said override means includes a means for reversing the direction of rotation of the said control motor as the signal generated by the thermocouple indicates a decreasing temperature in the combustion chamber below the second predetermined temperature.

10. The refuse disposal system of claim 7 wherein the charging means is hydraulically driven and the speed means includes a position proportioning electrical control motor operatively connected to a speed control valve means for metering the flow of hydraulic fluid to the hydraulic drive of the charging means and includes a position proportioning control unit operatively responsive to a signal generated by a thermocouple disposed in said combustion chamber to transmit an output signal to said proportioning electrical control motor.

11. The refuse disposal system of claim 9 wherein said reversing means includes a direction control relay operatively connected to the position proportioning electrical control motor and operatively responsive to a signal generated by a thermocouple disposed in said combustion chamber to transmit an output signal to the direction control relay to reverse the direction of rotation of the control motor when the signal generated by the thermocouple indicates a decreasing of temperature below the second predetermined temperature.

12. A refuse disposal system capable of incinerating heterogeneous refuse, said system comprising a combustion chamber, means disposed in the combustion chamber for supporting refuse to be burned, means for charging refuse onto the support means, overfire means for supplying an increasing flow of combustion air above the support means as the temperature of the gaseous products of combustion increases above a first predetermined temperature, and underfire means for supplying a decreasing flow of combustion air below the support means as the temperature of the gaseous products of combustion increases above the first predetermined temperature, and speed means for increasing the rate with which the charging means places refuse on the support means as the temperature of the gaseous products of combustion increases above the first predetermined temperature.

13. The refuse disposal system of claim 12 wherein the charging means is hydraulically driven and the speed means includes a position proportioning electrical control motor operatively connected to a speed control valve means for metering the flow of hydraulic fluid to the hydraulic drive of the charging means and includes a position proportioning control unit operatively responsive to a signal generated by a thermocouple disposed in said combustion chamber to transmit an output signal to said proportioning electrical control motor.

14. The refuse disposal system of claim 7 wherein the underfire means includes a position proportioning electrical control motor operatively connected to an underfire air supply and a position proportioning control unit operable responsive to a signal generated by a thermocouple disposed in said combustion chamber to transmit an output signal to said proportioning electrical control motor.

15. A refuse disposal system capable of incinerating heterogeneous refuse, said system comprising a combustion chamber, means disposed in the combustion chamber for supporting refuse to be burned, means for charging refuse onto the support means, and speed means for increasing the rate with which the charging means places refuse on the support means as the temperature of the gaseous products of combustion increases above a predetermined temperature.

* * * * *